US012013156B2

(12) United States Patent
Xu et al.

(10) Patent No.: US 12,013,156 B2
(45) Date of Patent: Jun. 18, 2024

(54) SOLID-STATE PASSIVE EVAPORATIVE COOLING SYSTEM AND METHOD

(71) Applicant: Zhejiang Normal University, Jinhua (CN)

(72) Inventors: Zisheng Xu, Jinhua (CN); Zhiyuan Zhang, Jinhua (CN); Shiju E, Jinhua (CN)

(73) Assignee: Zhejiang Normal University, Jinhua (CN)

( * ) Notice: Subject to any disclaimer, the term of this patent is extended or adjusted under 35 U.S.C. 154(b) by 0 days.

(21) Appl. No.: 18/353,122

(22) Filed: Jul. 17, 2023

(65) Prior Publication Data

US 2024/0027107 A1 Jan. 25, 2024

(30) Foreign Application Priority Data

Jul. 20, 2022 (CN) ..... 202210863274.8

(51) Int. Cl.
*F25B 19/00* (2006.01)
*F25D 7/00* (2006.01)

(52) U.S. Cl.
CPC ..... *F25B 19/00* (2013.01); *F25D 7/00* (2013.01)

(58) Field of Classification Search
CPC .. F25B 19/00; F25B 41/10; F25D 7/00; F24F 6/02; F24F 6/08
See application file for complete search history.

(56) References Cited

U.S. PATENT DOCUMENTS

| | | | | |
|---|---|---|---|---|
| 6,351,478 | B1 | 2/2002 | Heberle | |
| 11,435,766 | B2 | 9/2022 | Balma | |
| 2011/0077527 | A1* | 3/2011 | Yang | A61B 5/489 428/32.6 |
| 2023/0079415 | A1 | 3/2023 | Dunham | |

FOREIGN PATENT DOCUMENTS

| | | | |
|---|---|---|---|
| CN | 104953447 | A | 9/2015 |
| CN | 114735195 | A | 7/2022 |
| CN | 115039679 | A | 9/2022 |
| JP | 2005098674 | A * | 4/2005 |

* cited by examiner

*Primary Examiner* — Joseph F Trpisovsky
(74) *Attorney, Agent, or Firm* — True Shepherd LLC; Andrew C. Cheng

(57) ABSTRACT

A solid-state passive evaporative cooling system includes a hydrogel body, a water supply channel, a hydrogel root, and a water supply device. One end of the water supply channel is embedded into the hydrogel body, and a plurality of water outlets are formed in an outer wall of the water supply channel embedded into the hydrogel body. A water inlet at the other end of the water supply channel is connected to the water supply device which is configured to pump an aqueous solution into the water supply channel. The hydrogel root is disposed within the water supply channel. The aqueous solution is solidified by the hydrogel body to achieve the water-saving effect. During evaporative cooling, an osmotic pressure may be spontaneously created or enhanced within the system. The water supply channel is capable of adjusting the water content of the hydrogel body and providing a water supply driving force.

7 Claims, 7 Drawing Sheets

SOLID-STATE PASSIVE EVAPORATIVE COOLING SYSTEM AND METHOD

CROSS-REFERENCE TO RELATED APPLICATIONS

This application claims priority to Chinese Patent Application No. 202210863274.8 with a filing date of Jul. 20, 2022. The content of the aforementioned application, including any intervening amendments thereto, is incorporated herein by reference.

TECHNICAL FIELD

The present disclosure belongs to the technical field of evaporative cooling, and more particularly, relates to a solid-state passive evaporative cooling system and method.

BACKGROUND

Water evaporates and hence absorbs heat, which is a common physical phenomenon and can be applied in cooling. A passive cooling technique developed based on the principle of water evaporation may cool an object directly by the evaporation of water, thus avoiding the influence on the environment due to the construction of a complex mechanical structure and using of a coolant. For example, the evaporation of 1 kg of water may provide about 2500 kJ of cold quantity. Therefore, the passive evaporative cooling technique based on water has the characteristics of extremely low consumption and large cooling capacity, and thus has gradually attracted attention from people.

Some existing passive evaporation techniques mainly focus on applying water on an object, including retaining, pouring or spraying water on a surface. However, due to the amorphous state of water, water may be wasted during spraying and retaining of water may cause water pollution. Thus, further applications of a traditional passive evaporative cooling technique are limited, and extremely high requirements are put forward on hardware conditions used, such as water quality, water retaining capability and water treatment, leading to a greatly increased cost.

SUMMARY OF PRESENT INVENTION

In order address at least one of the existing technical issues of evaporation cooling, the present disclosure provides a solid-state passive evaporative cooling method and system. Compared with the traditional passive evaporative cooling technique, water fixation can be realized based on an all-solid-state evaporative cooling technique, preventing the wasting of water during evaporation and achieving an anti-fouling characteristic. Moreover, more efficient evaporative cooling performance can be realized under the action of three driving forces: transpiration, osmosis, and a driving force of a water supply channel. The reasons are as follows: the water in a hydrogel is a dispersion medium and has a smaller enthalpy of evaporation than liquid water, and an osmotic pressure may be spontaneously created within the system to drive the water to be efficiently transported within the evaporative cooling system, thus improving the cooling efficiency.

The technical solutions adopted in the present disclosure are described below.

In a first aspect, the present disclosure provides a solid-state passive evaporative cooling system, including a hydrogel body, water supply channel, a hydrogel root, and a water supply device; the water supply channel is connected to the water supply device; the water supply device is configured to pump an aqueous solution into the water supply channel; a plurality of water outlets is formed in a wall of the water supply channel and is embedded into the hydrogel body; and the hydrogel root is disposed within the water supply channel.

Preferably, a charged ionic network is formed within the hydrogel body and the hydrogel root.

Preferably, a plurality of water supply channel is parallel or crisscrossed within the hydrogel body.

Preferably, the hydrogel body has one side for direct contact with an object to be cooled and the other side for evaporative heat dissipation, and a microstructure is formed on a surface of the other side.

Preferably, one end of the hydrogel root is connected to the hydrogel body and fills up the water outlets of the water supply channel, and the other end of the hydrogel root is immersed into the aqueous solution within the water supply channel; and a shape of the other end of the hydrogel root is one of a plane, a sawtooth shape, and a triangle, or a combination thereof.

Preferably, a supercharging device is disposed within the water supply device.

In a second aspect, the present disclosure provides a method for preparing the solid-state passive evaporative cooling system described above, including the following steps:

S1, preparing a hydrogel solution;

S2, immersing a perforated water supply channel into an interfacial coupling agent solution, taking out and air-drying the water supply channel, and placing a plurality of water supply channel in a mold in parallel or crosswise;

S3, pouring the hydrogel solution into the mold, pumping air out of the water supply channel such that the hydrogel solution fills up the water supply channel (1), and allowing the mold to stand such that a hydrogel is polymerized and molded by photo-initiation or thermal initiation;

alternatively, pouring the hydrogel solution into the water supply channel, sealing the water supply channel at two ends after being full of the hydrogel solution, allowing the water supply channel to stand such that the hydrogel solution is molded, and placing the water supply channel into the mold; and pouring the hydrogel solution into the mold, and subjecting the hydrogel to be polymerized and molded by photo-initiation or thermal initiation; and S4, drilling a through hole from a port of the water supply channel located outside the hydrogel body along an axis of the water supply channel using a drilling device such that the drilled through hole penetrates through the water supply channel, wherein the through hole has a cross section, of which a shape is one of a plane, a sawtooth shape, and a triangle, or a combination thereof, and forms a hydrogel root; and the hydrogel root located within the water supply channel is integrally connected to the hydrogel body.

Preferably, a bottom of the mold is rough for forming a microstructure on the surface of the hydrogel body. The efficiency of water evaporation is improved, thus improving the efficiency of cooling.

In a third aspect, the present disclosure provides a cooling method using the solid-state passive evaporative cooling system described above, including:

contacting one side of the hydrogel body with the object to be cooled, pumping the aqueous solution having a lower ionic concentration than the hydrogel body into the water supply channel by the water supply device, and keeping a water pressure within the water supply channel;

when water evaporates from a surface of the hydrogel body, creating a transpirational pressure within the hydrogel body to drive the hydrogel root to absorb water and to drive water molecules to be transported within the hydrogel body, wherein dynamic evaporation at an evaporation interface of the hydrogel body results in an increased ionic concentration at the evaporation interface of the hydrogel body, which forms an ionic concentration gradient with an interior of the hydrogel body, and an osmotic pressure is created or increased due to an ionic concentration gradient difference; and driving water molecules to be transported from the water supply channel to an evaporation surface of the hydrogel body by the aqueous solution in the water supply channel under a combined action of the osmotic pressure, the transpirational pressure, and the water pressure, thus improving the efficiency of cooling.

Preferably, the osmotic pressure of the hydrogel root and the aqueous solution can be changed by adjusting a concentration and a type of the aqueous solution pumped by the water supply device into the water supply channel.

Compared with the prior art, the present disclosure has the following advantages:

1) In the solid-state passive evaporative cooling system provided in the present disclosure, at a solid-liquid interface of the hydrogel body and the aqueous solution, due to a difference in ionic concentration, the hydrogel body at the solid-liquid interface swells and has a reduced ionic concentration after swelling. Efficient transport of water molecules within the hydrogel body can be realized by adjusting a gradient of the ionic network within the hydrogel body. Meanwhile, the ionic network structure within the hydrogel body can guarantee that ions will not migrate to a low-concentration region due to evaporation and the transport of the water, thereby ensuring that the osmotic pressure within the hydrogel body is present persistently.

2) According to the present disclosure, the hydrogel root is constructed within the water supply channel to form a capillary channel, further improving the water transport characteristic of the hydrogel body.

3) The present disclosure has the characteristics of simple structure, strong heat dissipation capacity, and long duration, and is available for cooling an engine, a chip, a machine room, a container, a solar panel, and the like, and wide in application range.

LIST OF REFERENCE NUMERALS

1—water supply channel, 2—hydrogel body, 3—hydrogel root, 4—water supply device, 5—aqueous solution, 6—water inlet, and 7—water outlet.

DETAILED DESCRIPTION OF THE EMBODIMENTS

In order to make the objective, technical solutions, and advantages of the present disclosure clearer, the present disclosure is further described in detail below with reference to the accompanying drawings and examples. It should be understood that the specific examples described herein are merely intended to explain the present disclosure, but not to limit the present disclosure. Moreover, the technical features involved in the various embodiments of the present disclosure described below may be combined with one another as long as they do not constitute a conflict with each other.

Figure 1:
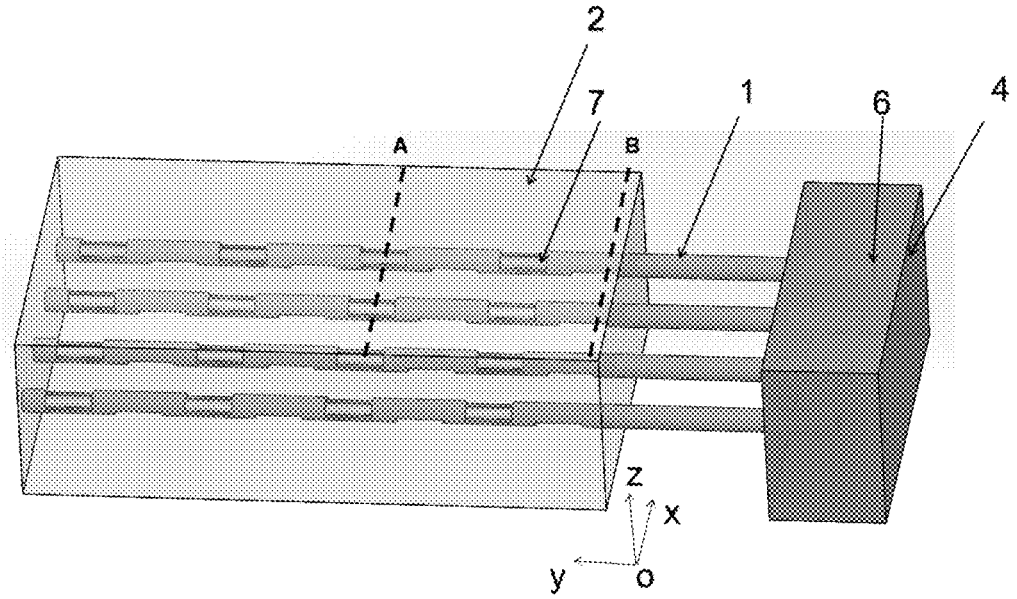
FIG. 1 is a schematic diagram of a solid-state passive evaporative cooling system according to an embodiment of the present disclosure.
Figure 2:
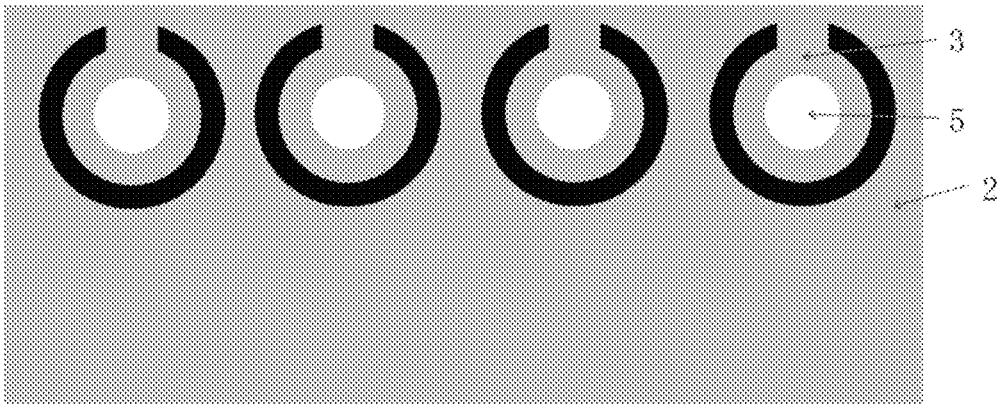
FIG. 2 is a schematic diagram of a cross section along a dotted line A shown in FIG. 1.
Figure 3:
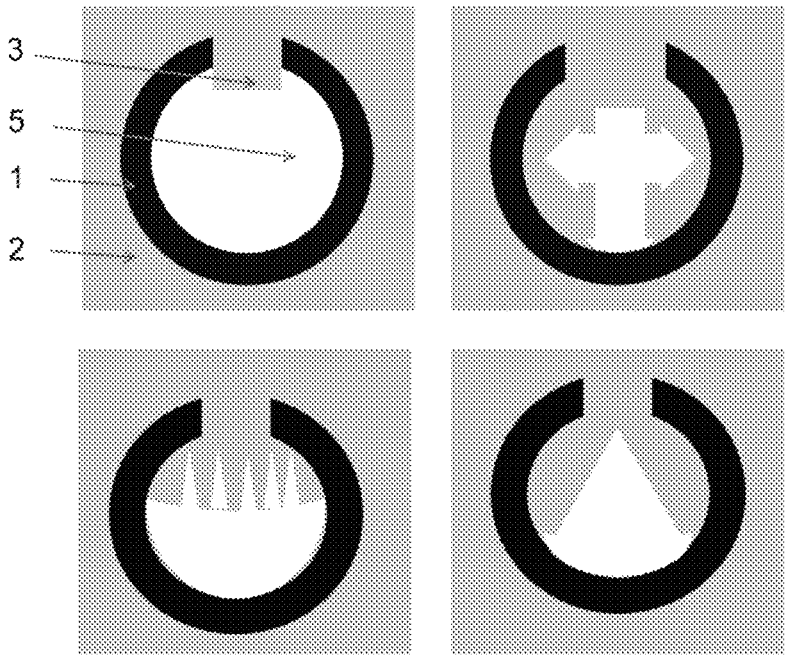
FIG. 3 is a schematic diagram showing a cross section of a single water pipe along a dotted line B shown in FIG. 1 and several different hydrogel root types.

As shown in FIG. 1 to FIG. 3, an embodiment of the present disclosure provides a solid-state passive evaporative cooling system mainly comprising: a water supply channel 1, a hydrogel body 2, a hydrogel root 3, and a water supply device 4. The water supply channel 1 includes a water inlet 6 and a water outlet 7. An aqueous solution 5 is pumped by the water supply device 4 into the water supply channel 1. The aqueous solution 5 and the hydrogel root 3 coexist within the water supply channel 1. The hydrogel structure comprises the hydrogel body 2 extending out of the water supply channel 1 and the hydrogel root 3 located within the water supply channel. The hydrogel root 3 simulates the functions of plant roots, which can absorb and store water and other elements from the water supply channel 1. The hydrogel root 3 regulates water supply to achieve evaporative cooling in the solid-state passive evaporative cooling system.

The water outlet 7 of the water supply channel 1 is located within the hydrogel body 2. The water supply channel is capable of replenishing water for the hydrogel body. Moreover, the mechanical properties of the system may be enhanced by adjusting the distribution of the water supply channel. In the present embodiment, a material of the water supply channel is not limited to organic and inorganic metal materials.

An ionic network with a certain charge is formed within the hydrogel body 2 and the hydrogel root 3. That is, the ionic network may be negatively charged or positively charged. The presence of the ionic network guarantees that it is hard for ions to migrate to a low-concentration region. Thus, it can be guaranteed that ions will not migrate due to the evaporation and the transport of water. Due to the presence of the ionic network, during evaporation, an ionic concentration at an evaporation interface of the hydrogel body increases dynamically as water evaporates. Thus, the solid-state passive evaporative passive cooling system of the present disclosure is capable of spontaneously creating an osmotic pressure at the interface and driving the water within the system to be transported to the evaporation interface.

One side of the hydrogel body 2 is in direct contact with an object to be cooled. In the present embodiment, an interfacial coupling agent is applied to a surface of the object to be cooled to increase an effective contact between the hydrogel body and the object to be cooled. Another side of the hydrogel body is used for evaporative heat dissipation, and a microstructure is disposed on the surface of another side to help improving the heat dissipation effect. A roughened surface may be provided as the microstructure so that the evaporation area of the hydrogel body can be increased, which in turns contributes to the improvement of the evaporation efficiency of the hydrogel body.

The hydrogel root 3 extends into the water supply channel from the water outlet 7 of the water supply channel 1. One end of the hydrogel root 3 is connected to the hydrogel body 2, and the other end of the hydrogel root 3 is immersed into the aqueous solution within the water supply channel 1 for absorbing and storing water. Since the hydrogel root has the ionic network and creates an osmotic pressure with the aqueous solution, the hydrogel root actively absorbs water from the aqueous solution under the action of the osmotic pressure. Since a vapor pressure is created after the evaporative water loss of the hydrogel body outside the water supply channel, a water potential difference is formed between the external hydrogel body and the hydrogel root, and the hydrogel root absorbs water from the water supply channel and transports the water upwards under transpiration. Moreover, the swelling of the hydrogel root after absorbing water may greatly improve the capability of obtaining and storing water within the hydrogel body, guaranteeing that the hydrogel body can work stably for a long time.

The water supply device 4 is configured to pump the aqueous solution into the water supply channel 1. A shape of the water supply device is not limited. A supercharging device is disposed within the water supply device. A supercharging way includes but is not limited to supercharging by gravitational potential energy, supercharging by a booster pump, supercharging by a pressure, etc. Under the action of a water pressure, the aqueous solution of the water supply channel is transported into the hydrogel body. Meanwhile, the hydrogel root is acted upon by the pressure, the water stored in the hydrogel root is transported to the hydrogel body outside the water supply channel.

In a specific implementation of the present disclosure, as shown in FIG. 3, the surface microstructure of the hydrogel root within the water supply channel may be designed arbitrarily, including one of a plane, a sawtooth shape, and a triangle, or a combination thereof. The surface design improves the water absorbing and storing capability of the hydrogel root.

The aqueous solution in the water supply channel 1 in the solid-state passive evaporative cooling system of the present disclosure drives water molecules to be transported from the water supply channel 1 to an evaporation surface of the hydrogel body 2 under a combined action of the osmotic pressure, the transpirational pressure, and the water pressure, thus improving the efficiency of cooling the object to be cooled. Its principle is as follows: the hydrogel body in the solid-state passive evaporative cooling system has one side in contact with the object to be cooled and another side exposed as the evaporation interface to the external environment. When water evaporates from the surface of the hydrogel body, a transpirational pressure is created within the hydrogel body to drive the hydrogel root to absorb water and to drive the water to be transported within the hydrogel body. Dynamic evaporation at the evaporation interface of the hydrogel body results in an increased ionic concentration at the evaporation interface of the hydrogel body, which forms an ionic concentration gradient with an interior of the hydrogel body. An osmotic pressure difference is formed due to an ionic concentration gradient difference. Driven by the osmotic pressure, water molecules can be transported along the ionic concentration gradient. That is, under the action of evaporation, the osmotic pressure difference is formed such that the water molecules within the hydrogel body are transported to the evaporation interface, thus improving the cooling efficiency. Moreover, since the hydrogel body has the ionic network therein, it can be guaranteed that irons will not migrate to a low-concentration region due to evaporation and the transport of the water, thereby ensuring that the osmotic pressure within the hydrogel body is present persistently.

In a specific implementation of the present disclosure, the osmotic pressure of the hydrogel root and the aqueous solution and the water storage performance can be improved by adjusting a concentration and a type of the aqueous solution. Meanwhile, excessive water absorption swelling (excessive water content) of the hydrogel body can be inhibited, thereby avoiding influence on evaporation. Accordingly, the mechanical properties of the solid-state passive evaporative cooling system of the present disclosure can be improved, and the evaporative cooling efficiency can be enhanced.

In a specific implementation of the present disclosure, by regulating a position of the water supply channel and a pressure intensity of the water supply device, the driving force is increased for the water within the water supply channel such that the water is transported into the hydrogel root. Meanwhile, the pressure drives the water in the hydrogel root to be transported upward. Moreover, the hydrogel root is constructed within the water supply channel to form a capillary channel so that the water transport characteristic of the hydrogel body can be further improved.

A method for preparing the solid-state passive evaporative cooling system described above is as follows.

S1, A hydrogel solution is prepared. Specifically, a hydrogel monomer, a cross-linking agent, and an initiator are prepared in a certain ratio into an aqueous hydrogel solution, and meanwhile, a charged monomer solution is prepared. The charged monomer solution and the hydrogel solution are mixed in a molar ratio.

S2, A perforated water supply channel is immersed into an interfacial coupling agent solution for 2 minutes, and then taken out and air-dried. A plurality of water supply channel is placed in a mold in parallel or crosswise.

S3, The hydrogel solution is poured into the mold, and air is pumped out of the water supply channel such that the hydrogel solution fills up the water supply channel (1). The mold is allowed to stand such that the hydrogel solution is polymerized and molded into a hydrogel under irradiation by an ultraviolet lamp in an oxygen-free environment.

Alternatively, the hydrogel solution is poured into the water supply channel, and the water supply channel are sealed at two ends after being full of the hydrogel solution, allowed to stand such that the hydrogel solution is molded, and then placed into the mold. The hydrogel solution is poured into the mold, and caused to be polymerized and molded into a hydrogel under irradiation by an ultraviolet lamp in an oxygen-free environment.

Depending on the type of the initiator, polymerization is initiated to produce the hydrogel body having a charged ionic network therein.

S4, A through hole is drilled from a port of each water supply channel located outside the hydrogel body along an axis of the water supply channel using a drilling device such that the drilled through hole penetrates through the water supply channel. The through hole has a cross section, of which a shape is one of a plane, a sawtooth shape, and a triangle, or a combination thereof, and forms a hydrogel root. The hydrogel root located within the water supply channel is integrally connected to the external hydrogel body.

In a specific implementation of the present disclosure, in step S1, a molar ratio of the monomer to the initiator is 1:0.0001 to 1:0.1, and a molar ratio of the monomer to the cross-linking agent is 1:0.0001 to 1:0.1.

The charged monomer may include but be not limited to a positively charged monomer, a negatively charged monomer and a mixture thereof. The charged monomer may be one selected from the group consisting of methacryloxyethyltrimethyl ammonium chloride, acryloxyethyltrimethyl ammonium chloride, ethyleneimine, vinylamine, acrylic acid, sodium acrylate, methacrylic acid, vinyl sulfonic acid, sodium p-styrenesulfonate, 4-vinyl-propanesulfonic acid sodium, sodium 2-acryloylamido-2-methylpropanesulfonate, vinylpyridine, and the like. A neutral monomer may be one or more selected from the group consisting of acrylamide series, polyvinyl alcohol series, hydroxyethyl cellulose series, sodium alginate, carboxymethylcellulose, agarose, chitosan, hyaluronic acid, and gelatin. The cross-linking agent may be one selected from the group consisting of N,N'-methylene bisacrylamide and propane diamine. The initiator may be a photoinitiator or a thermal initiator, e.g., one of redox initiators, organic peroxides, inorganic peroxides, and azo initiators, such as ammonium persulfate, potassium persulfate, 2-hydroxy-4'-2-hydroxyethoxy-2-methyl acetophenone, and phenylbenzyl ketone. The interfacial coupling agent may be one selected from the group consisting of silane coupling agent and benzophenone.

The hydrogel body may also have both positive and negative ionic networks and may be a combination of hydrogel bodies having different ionic networks, respectively. The bonding of the hydrogel body to the interface may also be electrostatic bonding.

Without damaging the water supply channel, an opening manner, a size, a shape, and a position of the water outlet of the water supply channel are not limited.

In a specific implementation of the present disclosure, the hydrogel solution is prepared as follows.

Example 1: (1) 0.01 M N,N'-methylene bisacrylamide is added to a 2 M acrylamide solution and stirred until it is dissolved. (2) An equal amount of 2 M sodium 2-acryloylamido-2-methylpropanesulfonate is added to the solution obtained in step 1. (3) An equal amount of the solution is stirred and mixed. (4) A 2 wt % agarose and a 2/1000 M photoinitiator are added, and stirred in a water bath at 90° C. for dissolving to obtain a clear hydrogel solution.

Example 2: (1) 0.01 M N,N'-methylene bisacrylamide is added to a 2 M acrylamide solution and stirred until it is dissolved. (2) An equal amount of 2 M sodium 2-acryloylamido-2-methylpropanesulfonate is added to the solution obtained in step 1. (3) An equal amount of the solution is stirred and mixed. (4) A 2 wt % agarose and a 2/1000 M photoinitiator are added, and stirred in a water bath at 90° C. for dissolving to obtain a clear hydrogel solution.

Example 3: (1) 0.01 M N,N'-methylene bisacrylamide is added to a 2 M acrylamide solution and stirred until it is dissolved. (2) An equal amount of 2 M sodium 2-acryloylamido-2-methylpropanesulfonate is added to the solution obtained in step 1. (3) An equal amount of the solution is stirred and mixed. (4) A 2 wt % agarose and a 2/1000 M photoinitiator are added, and stirred in a water bath at 90° C. for dissolving to obtain a clear hydrogel solution, which forms a hydrogel solution with a cationic monomer.

In a specific implementation of the present disclosure, in step S3, the hydrogel solution may be poured into the mold, and air is pumped out of the water supply channel such that the hydrogel solution fills up the water supply channel. The mold is allowed to stand such that the hydrogel solution is polymerized and molded into a hydrogel under irradiation by an ultraviolet lamp. Thus, the hydrogels inside and outside the water supply channel are the same, and the hydrogel body and the hydrogel root carry like charges. The hydrogel solution may also be poured into the water supply channel. The water supply channel are sealed at two ends after being full of the hydrogel solution, allowed to stand such that the hydrogel solution is molded, and then placed into the mold. The hydrogel solution is poured into the mold, and caused to be polymerized and molded into the hydrogel under irradiation by the ultraviolet lamp in the oxygen-free environment. The method is capable of preparing difference structures of the hydrogels inside and outside the water supply channel. The hydrogel root and the hydrogel body carry unlike charges, forming electrostatic assembly, and an interfacial electric field can be formed at the interface of the two. Thus, the transport of water is improved and transpiration is enhanced.

In a specific implementation of the present disclosure, in step S4, a hole is drilled in the water supply channel by using the drilling device. An aqueous solution at a low concentration is pumped by the water supply device. The hydrogel body absorbs water through the internal water outlet of the water supply channel to swell, and finally, a root structure is formed within the water supply channel. In the present embodiment, the aqueous solution at a low concentration may be one or a mixed solution of several of pure water, domestic water, ammonia water, and saline water. The saline water may be any salt solution, which may be one or a mixture of several of NaCl, KCl, $CuSO_4$, LiCl, LiBr, $Zn(ClO_4)_2$, $K_2S_2O_8$, and ZnCl.

For ease of comparison, a traditional water-retaining passive evaporative cooling system is used for comparison with the solid-state passive evaporative cooling system. An evaporative cooling way of the traditional water-retaining passive evaporative cooling system is introducing 5 mm high domestic water into a water tank. In the present embodiment, the prepared system, the hydrogel body and the traditional water-retaining passive evaporative cooling system are placed into a 60° C. constant temperature and humidity box for testing the evaporative cooling capability as follows.

Step 1, The solid-state passive evaporative cooling system and the water-retaining passive evaporative cooling system are placed into the 60° C. constant temperature and humidity box.

Step 2, Temperature monitoring is performed on the two cooling systems and the ambient environment for 6 hours.

Figure 4:
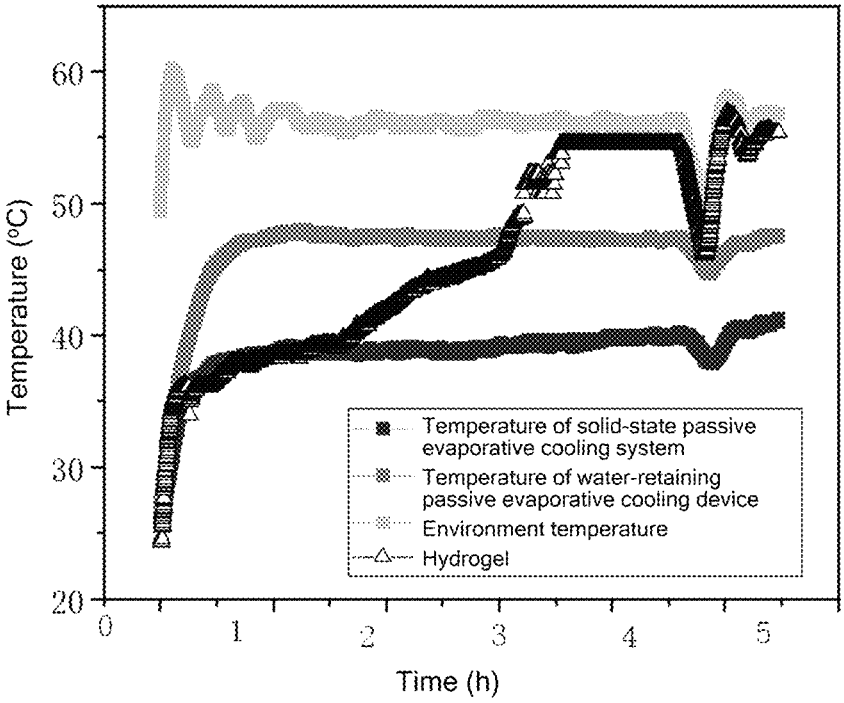
FIG. 4 is a schematic diagram of comparison on performance between a solid-state passive evaporative cooling system according to an embodiment of the present disclosure and a traditional water-retaining evaporative cooling system.

As shown in FIG. 4, it is obvious that the cooling capability of the solid-state passive cooling system exceeds the cooling capability of the traditional water-retaining passive evaporative cooling system and that of the single hydrogel body by far.

Figure 5:
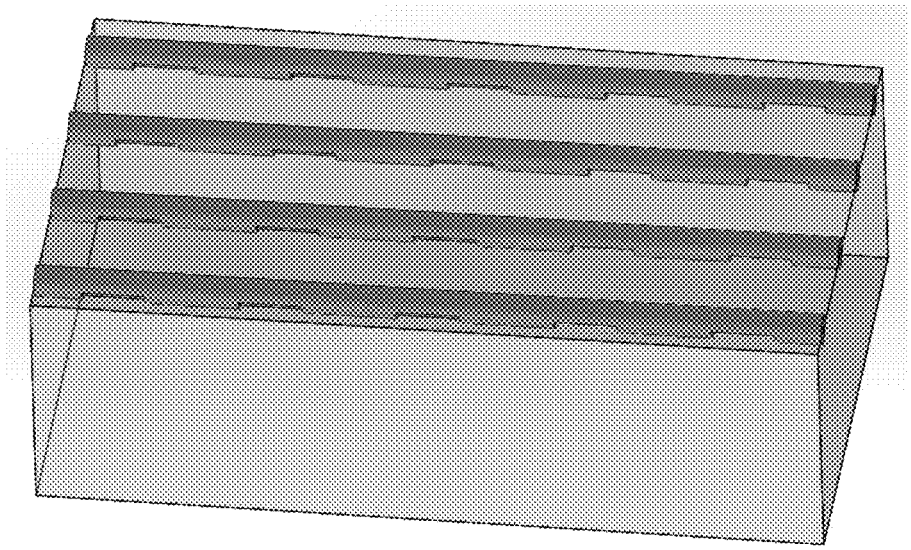
FIG. 5 is a schematic diagram of water supply channels being arranged in parallel within a hydrogel body according to an embodiment of the present disclosure.
Figure 6:
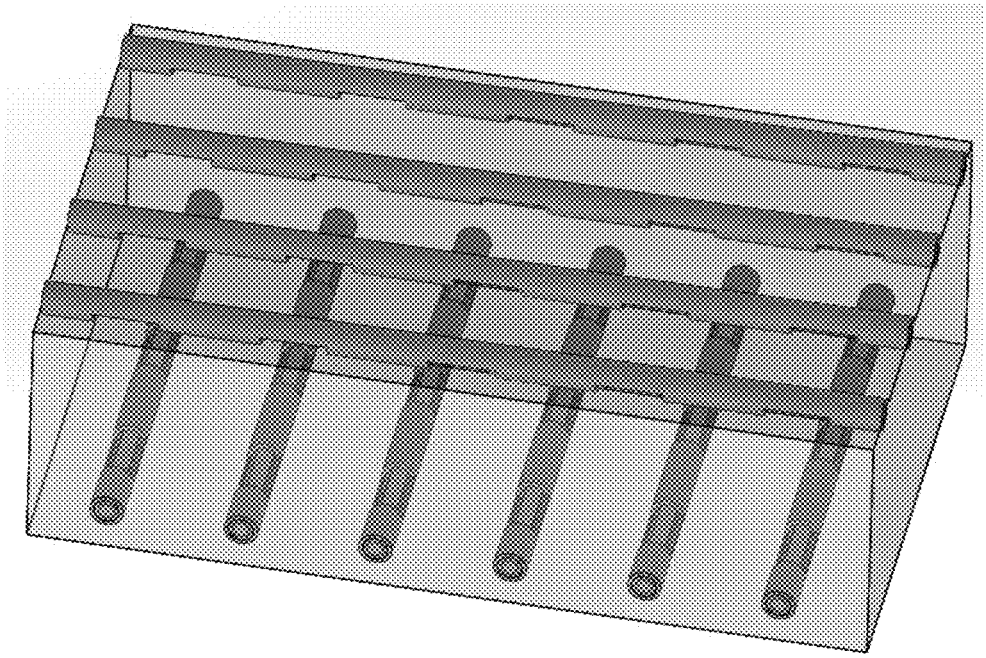
FIG. 6 is a schematic diagram of water supply channels being crisscrossed within a hydrogel body according to an embodiment of the present disclosure.
Figure 7:
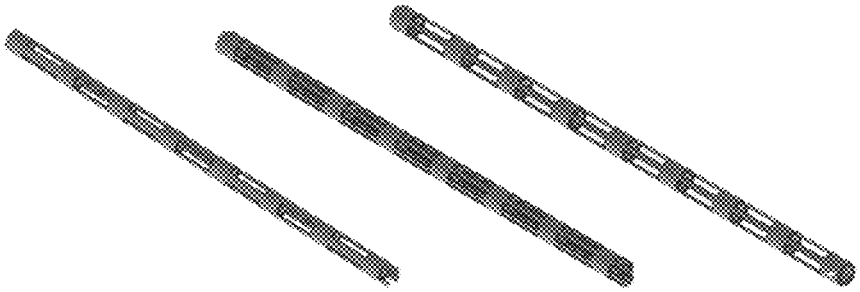
FIG. 7 is a structural schematic diagram of three water supply channels according to an embodiment of the present disclosure.

As shown in FIG. 5, the water supply channel are located above the solid-state passive evaporative cooling system and are capable of replenishing water for the hydrogel body by means of the gravitational potential energy of the water. A combination of the water supply channel is not limited to transverse distribution and longitudinal distribution, and may also be of a crisscrossed network structure as shown in FIG. 6. Moreover, an orientation and the number of the water outlets of the water supply channel are not limited and can be adjusted according to actual requirements. FIG. 7 illustrates a schematic diagram of three alternative water supply channel structures.

In a specific implementation of the present disclosure, the area of the evaporation interface of the hydrogel is increased by improving the roughness of the surface of the hydrogel, thus realizing efficient evaporative cooling. More specifically, a hydrogel prepolymer solution is poured into a rough abrasive tool having different meshes therein, such as a glass abrasive tool or an abrasive paper. After the hydrogel prepolymer solution is polymerized, a hydrogel having different surface microstructures on the surface thereof can be obtained. Moreover, different surface microstructures may also be obtained by using a physical shearing or abrasive processing method.

To improve the water transport characteristic of the hydrogel body, pores may be created within the hydrogel body of the evaporative cooling system by piercing, and the transport capability of water within the hydrogel body may be improved under the capillary action of the pores. Piecing may be performed in a transverse direction or/and a longitudinal direction.

A process of cooling an object to be cooled by using the solid-state passive evaporative cooling system described above is as follows:

One side of the hydrogel body 2 in the solid-state passive evaporative cooling system is brought into contact with the object to be cooled. An aqueous solution having a lower ionic concentration than the hydrogel body is pumped into the water supply channel 1 by the water supply device 4, and a water pressure is kept within the water supply channel 1. The osmotic pressure of the hydrogel root and the aqueous solution is changed by adjusting a concentration and a type of the aqueous solution pumped by the water supply device 4 into the water supply channel 1.

When water evaporates from a surface of the hydrogel body, a transpirational pressure is created within the hydrogel body to drive the hydrogel root 3 to absorb water and to drive water molecules to be transported within the hydrogel body. Dynamic evaporation at the evaporation interface of the hydrogel body results in an increased ionic concentration at the evaporation interface of the hydrogel body, which forms an ionic concentration gradient with the interior of the hydrogel body, and the osmotic pressure is created or increased due to an ionic concentration gradient difference.

The aqueous solution in the water supply channel 1 drives water molecules to be transported from the water supply channel 1 to the evaporation surface of the hydrogel body 2 under a combined action of the osmotic pressure, the transpirational pressure, and the water pressure, thus improving the efficiency of cooling the object to be cooled.

The embodiments listed above are merely specific embodiments of the present disclosure. Apparently, the present disclosure would not be limited to the above embodiments, and many variations are possible. All modifications that can be directly derived or conceived by a person of ordinary skill in the art from the description of the present disclosure should be regarded as falling into the protection scope of the present disclosure.

What is claimed is:

1. A solid-state passive evaporative cooling system, comprising a hydrogel body (2), a water supply channel (1), a hydrogel root (3), and a water supply device (4), wherein the water supply channel (1) is connected to the water supply device (4); the water supply device (4) is configured to pump an aqueous solution into the water supply channel (1); a plurality of water outlets (7) are formed in a wall of the water supply channel (1) and are embedded into the hydrogel body (2); and the hydrogel root (3) is disposed within the water supply channel (1); one end of the hydrogel root (3) is connected to the hydrogel body (2) and fills up the water outlets (7) of the water supply channel (1), and another end of the hydrogel root (3) is immersed into the aqueous solution within the water supply channel (1); and a shape of the another end of the hydrogel root (3) is one of a plane, a sawtooth shape, and a triangle, or a combination thereof; a charged ionic network is formed within the hydrogel body (2) and the hydrogel root (3).

2. The solid-state passive evaporative cooling system according to claim 1, wherein the hydrogel body (2) has one side for direct contact with an object to be cooled and another side for evaporative heat dissipation, and a microstructure is formed on a surface of the another side.

3. The solid-state passive evaporative cooling system according to claim 1, wherein a supercharging device is disposed within the water supply device (4).

4. A method for preparing the solid-state passive evaporative cooling system according to claim 1, comprising the following steps:

S1, preparing a hydrogel solution;

S2, immersing the water supply channel (1) into an interfacial coupling agent solution, taking out and air-drying the water supply channel (1), and placing a plurality of water supply channels (1) in a mold in parallel or crosswise;

S3, pouring the hydrogel solution into the mold, pumping air out of the water supply channel such that the hydrogel solution fills up the water supply channel (1), and allowing the mold to stand such that a hydrogel is polymerized and molded by photo-initiation or thermal initiation;

alternatively, pouring the hydrogel solution into the water supply channel, sealing the water supply channel at two ends after being full of the hydrogel solution, allowing the water supply channel to stand such that the hydrogel solution is molded and placing the water supply channel into the mold; and pouring the hydrogel solution into the mold, and subjecting the hydrogel to be polymerized and molded by photo-initiation or thermal initiation; and S4, drilling a through hole from a port of the water supply channel (1) located outside the hydrogel body (2) along an axis of the water supply channel using a drilling device such that the drilled through hole penetrates through the water supply channel (1), wherein the through hole has a cross section, of which a shape is one of a plane, a sawtooth shape, and a triangle, or a combination thereof, and forms the hydrogel root (3);

and the hydrogel root (3) located within the water supply channel (1) is integrally connected to the hydrogel body (2).

5. The method according to claim 4, wherein a bottom of the mold is rough for forming the microstructure on the surface of the hydrogel body (2).

6. A cooling method using the solid-state passive evaporative cooling system according to claim 1, comprising:

contacting one side of the hydrogel body (2) with an object to be cooled, pumping the aqueous solution having an ionic concentration lower than an ionic concentration of the hydrogel body into the water supply channel (1) by the water supply device (4), and keeping a water pressure within the water supply channel (1);

when water evaporates from a surface of the hydrogel body, creating a transpirational pressure within the hydrogel body to drive the hydrogel root (3) to absorb water and to drive water molecules to be transported within the hydrogel body, wherein dynamic evaporation at an evaporation interface of the hydrogel body results in an increased ionic concentration at the evaporation interface of the hydrogel body, which forms an ionic concentration gradient with an interior of the hydrogel body, and an osmotic pressure is created or increased due to an ionic concentration gradient difference; and driving water molecules to be transported from the water supply channel (1) to an evaporation surface of the hydrogel body (2) by the aqueous solution in the water supply channel (1) under a combined action of the osmotic pressure, the transpirational pressure and the water pressure, thus improving an efficiency of cooling.

7. The cooling method according to claim 6, wherein the osmotic pressure of the hydrogel root and the aqueous solution is changed by adjusting a concentration and a type of the aqueous solution pumped by the water supply device (4) into the water supply channel (1).

* * * * *